US005578172A

United States Patent [19]

Graf

[11] Patent Number: 5,578,172

[45] Date of Patent: Nov. 26, 1996

[54] SLICE BEAM SUPPORT PLATE

[75] Inventor: Edwin X. Graf, Menasha, Wis.

[73] Assignee: Voith Sulzer Papiermaschinen GmbH, Heidenheim, Germany

[21] Appl. No.: 359,878

[22] Filed: Dec. 20, 1994

[51] Int. Cl.[6] ..... D21F 1/02

[52] U.S. Cl. ..... 162/344; 162/336; 162/347

[58] Field of Search ..... 162/336, 344, 162/347

[56] References Cited

U.S. PATENT DOCUMENTS

| | | | |
|---|---|---|---|
| 3,309,264 | 3/1967 | Parker et al. | 162/336 |
| 3,738,910 | 6/1973 | De Noyer | 162/347 |
| 3,976,539 | 8/1976 | Kirjavainen | 162/344 |
| 4,836,895 | 6/1989 | Egelhof | 162/344 |
| 5,034,101 | 7/1991 | Wolf et al. | 162/336 |
| 5,152,873 | 10/1992 | Juhas et al. | 162/347 |
| 5,277,765 | 1/1994 | Graf et al. | 162/342 |

FOREIGN PATENT DOCUMENTS 492190 7/1992 European Pat. Off. .

*Primary Examiner*—Karen M. Hastings
*Attorney, Agent, or Firm*—Baker & Daniels

[57] ABSTRACT

The invention is directed to a headbox for a machine used in the production of a fiber material web from a fiber suspension. The headbox includes a bottom and a plurality of walls defining a main chamber. A slice beam, defining a width of the outlet channel, is pivotably connected to at least one of the walls and is disposed adjacent to the front wall. The slice beam and the bottom define an adjustable outlet channel therebetween. A support plate extends substantially across the width and is pivotably connected at opposing first and second edges thereof to each of the front wall and the slice beam. The support plate inhibits deflections of the slice beam along the width.

10 Claims, 2 Drawing Sheets

SLICE BEAM SUPPORT PLATE

BACKGROUND OF THE INVENTION

1. Field of the Invention

The present invention relates to a headbox for a machine for the production of a fiber material web, and, more particularly, to a headbox having an adjustable outlet channel.

2. Description of the Related Art

A paper making machine, as is known, has a specific machine width corresponding to the desired width of a fiber material web to be produced. The fiber material web is continuously formed from the fiber suspension by applying a machine-wide fiber suspension flow onto a continuous and revolving wire belt. A headbox serves to form a fiber suspension flow which is generally uniform across the machine width so that a finished fiber material web possesses generally uniform properties across its width. The headbox includes a feed channel, a main chamber and an outlet channel. Disposed adjacent the outlet channel may be a slice beam which is movable relative to the bottom of the headbox and thereby defines a variable outlet channel. The slice beam is designed to accommodate a slow and/or fast suspension flow through the headbox.

U.S. Pat. No. 5,277,765 (Graf et al), assigned to the assignee of the present invention, the disclosure of which is incorporated herein by reference, describes a headbox having a partitioning wall disposed between two rolls within the main chamber. The partitioning wall prevents flocculation of the fiber suspension flow during low flow rate conditions within the headbox. The slice beam or movable channel wall includes an arm at each longitudinal end thereof which is connected to a stiff portion of the headbox. The arms are simultaneously used to adjust the slice beam relative to the bottom of the headbox.

In a high speed headbox, i.e., a headbox with a fiber suspension velocity at a high rate, a relatively large pressure is exerted against the bottom surface of the slice beam by the fiber suspension. If the slice beam is only supported at each longitudinal end thereof, the pressure exerted by the suspension flow across the slice beam flexes or bows the slice beam in the middle portion thereof. This results in an uneven application of fiber suspension flow from the headbox, which is undesirable.

U.S. Pat. No. 5,034,101 (Wolf et al), also assigned to the assignee of the present invention and incorporated herein by reference, discloses an apparatus for preventing flexure of the slice beam. In general, a support or reaction beam is used to provide reactionary counterforces to the slice beam and thereby prevent flexure of the slice beam. A fluid filled pressure cushion is disposed between the support beam and the slice beam and distributes the load from the slice beam to the support beam to prevent flexure of the slice beam.

U.S. Pat. No. 3,738,910 (De Noyer), assigned to Allis-Chalmers Corporation (a predecessor to the assignee of the present invention), discloses another way of adjusting the cross profile flow of fiber suspension from an outlet channel. De Noyer uses a plurality of spindles to effect a local adjustment of the slice lip across the working width thereof. Such an apparatus requires an active control system to separately adjust each of the individual spindles.

A problem with an apparatus as disclosed by De Noyer is that the adjustment of the slice beam may vary from one point to another across the machine width. Local differences in the adjustment of the slice lip may result in cross flows of the suspension, which are undesirable.

What is needed in the art is an apparatus which inhibits flexure of the slice beam, and which is relatively inexpensive and does not require an elaborate control system.

SUMMARY OF THE INVENTION

The present invention provides a support plate which extends substantially across the width of the slice beam and is pivotably connected at opposing edges thereof to each of the front wall and slice beam, thereby inhibiting deflections of the slice beam along the width thereof.

The invention comprises, in one form thereof, a headbox for a machine used in the production of a fiber material web from a fiber suspension. The headbox includes a bottom and a plurality of walls defining a main chamber. A slice beam, defining a width of the outlet channel, is pivotably connected to at least one of the walls and is disposed adjacent to the front wall. The slice beam and the bottom define an adjustable outlet channel therebetween. A support plate extends substantially across the width and is pivotably connected at opposing first and second edges thereof to each of the front wall and the slice beam. The support plate inhibits deflections of the slice beam along the width.

An advantage of the present invention is that deflections of the slice beam along the width thereof are inhibited.

Another advantage is that deflections of the slice beam along the width thereof are inhibited without the use of an elaborate control system, such as a beam deflection compensation system.

Yet another advantage is that continuous support is provided across the entire width of the slice beam, to thereby inhibit deflections of the slice beam.

A further advantage is that the support plate interconnecting the slice beam and front wall prevents foreign matter such as dirt from interfering with the hinged connection between the slice beam and front plate.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
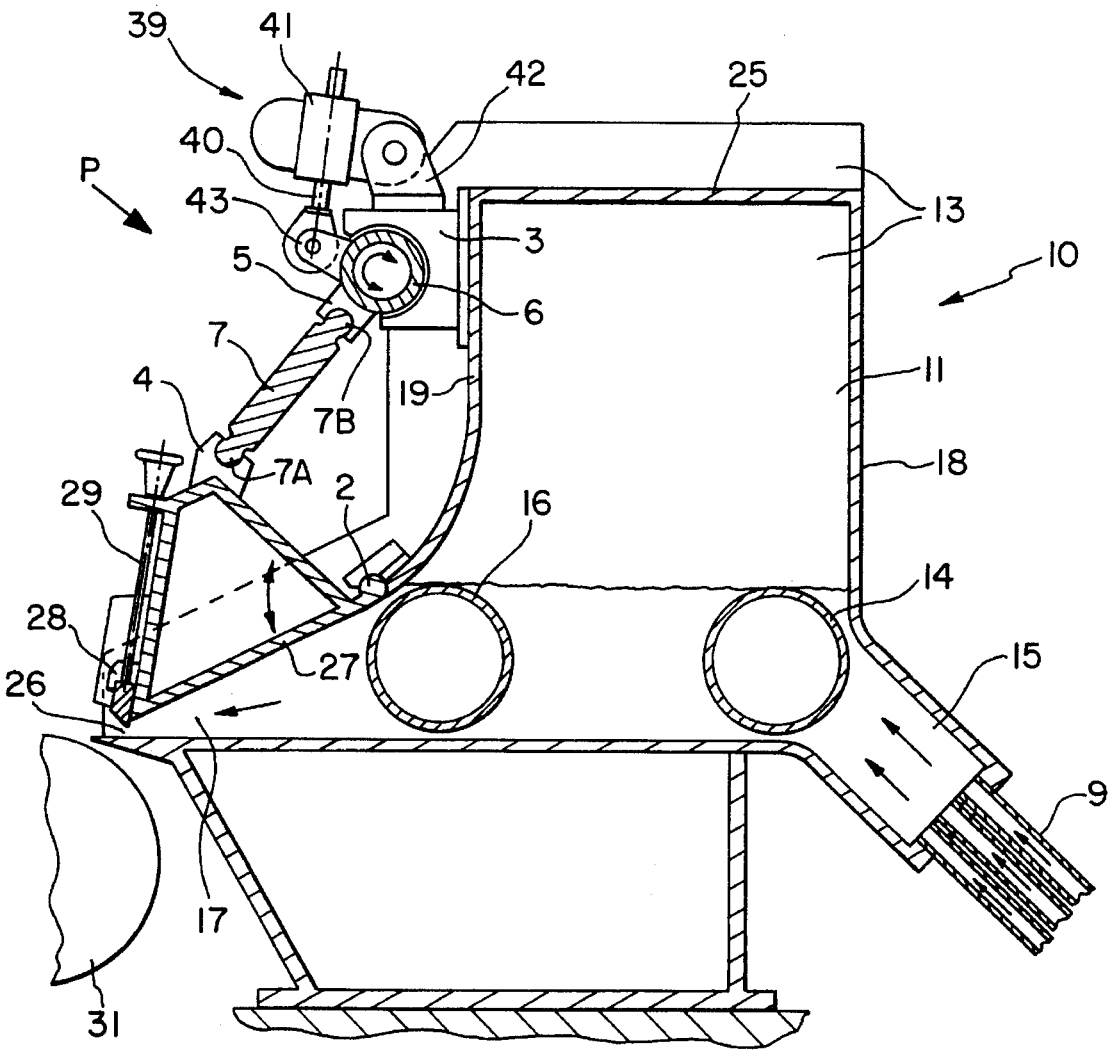
FIG. 1 is a side sectional view of a headbox including one embodiment of a slice beam support plate of the present invention.

Referring now to the drawings, and particularly to FIG. 1, a machine for producing a fiber material web from a fiber suspension generally includes a breast roll 31 and a headbox 10. Breast roll 31, which is partially shown in FIG. 1, rotatably carries a continuous wire belt (not shown) of the paper machine on which a fiber material web is formed in known fashion from the fiber suspension discharged from headbox 10. Headbox 10 includes a bundle of turbulence tubes 9, a feed channel 15, a main chamber 11 and a nozzle type outlet channel 17. Main chamber 11 is defined by a preferably horizontal bottom 12 and by two vertical side walls 13. Side walls 13 extend parallel to the longitudinal machine direction and allow the fiber suspension 8 to flow through the bottom area of the main chamber 11 in the longitudinal machine direction. Provided at the transition point from the feed channel 15 to the main chamber 11 is a first rotatable perforated roll 14 which is rotatably mounted in side walls 13. An identical second perforated roll 16 is provided at the transition point from the main chamber 11 to the outlet channel 17. Further components defining the main chamber 11 are a rear wall 18, a front wall 19 and top wall 25.

As shown in FIG. 1, the height of main chamber 11 is considerably greater than the (variable) level of fiber suspension 8 flowing through main chamber 11. Contained above the level of the fiber suspension level in main chamber 11 is thus an air cushion. The pressure of this air cushion can be varied in known manner in accordance with the desired flow velocity at the discharge gap 26, which is located at the end of the nozzle type outlet channel 17. The clearance of the discharge gap 26 can be varied in known manner using a movable slice beam 27 and, additionally, by means of a slat 28. Slat 28 (also called a "slice blade") can be slightly deformed locally for purposes of locally correcting the clearance of discharge gap 26 using a plurality of spindles 29 attached thereto. Spindles 29 are arranged in a distributed manner across the machine width.

According to the present invention, a support plate 7 extends substantially across the width of slice beam 27 and is pivotally connected at opposing first and second edges 7*a*, 7*b* to each of front wall 19 and slice beam 27. More particularly, first and second edges 7*a*, 7*b* define respective male members which are pivotably and non-removably disposed in female sockets 4, 5. Socket 4 is directly fastened to slice beam 27, and socket 5 is interconnected to front wall 19 via rotating beam 6.

A spindle drive assembly 39 is connected to rotating beam 6, and together form an adjustment mechanism that functions to move support plate 7 and slice beam 27. Spindle drive assembly 39 includes a motor 41 connected to a hinge 42. Hinge 42 is fastened to housing 3, which in turn is affixed to front wall 19. Housing 3 rotatably carries rotating beam 6. Motor 41 carries a shaft 40 and moves shaft 40 in a longitudinal direction thereof. Shaft 40 is pivotably connected to rotating beam 6 at ears 43.

Figure 2:
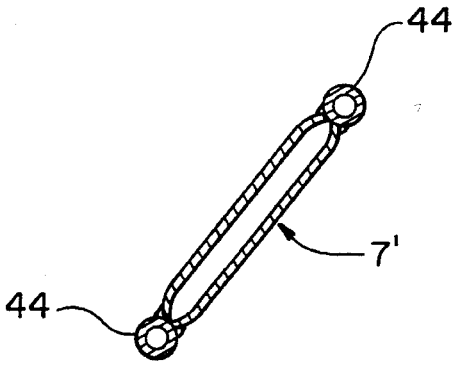
FIG. 2 is a side sectional view of another embodiment of the slice beam support plate of the present invention.
Figure 3:
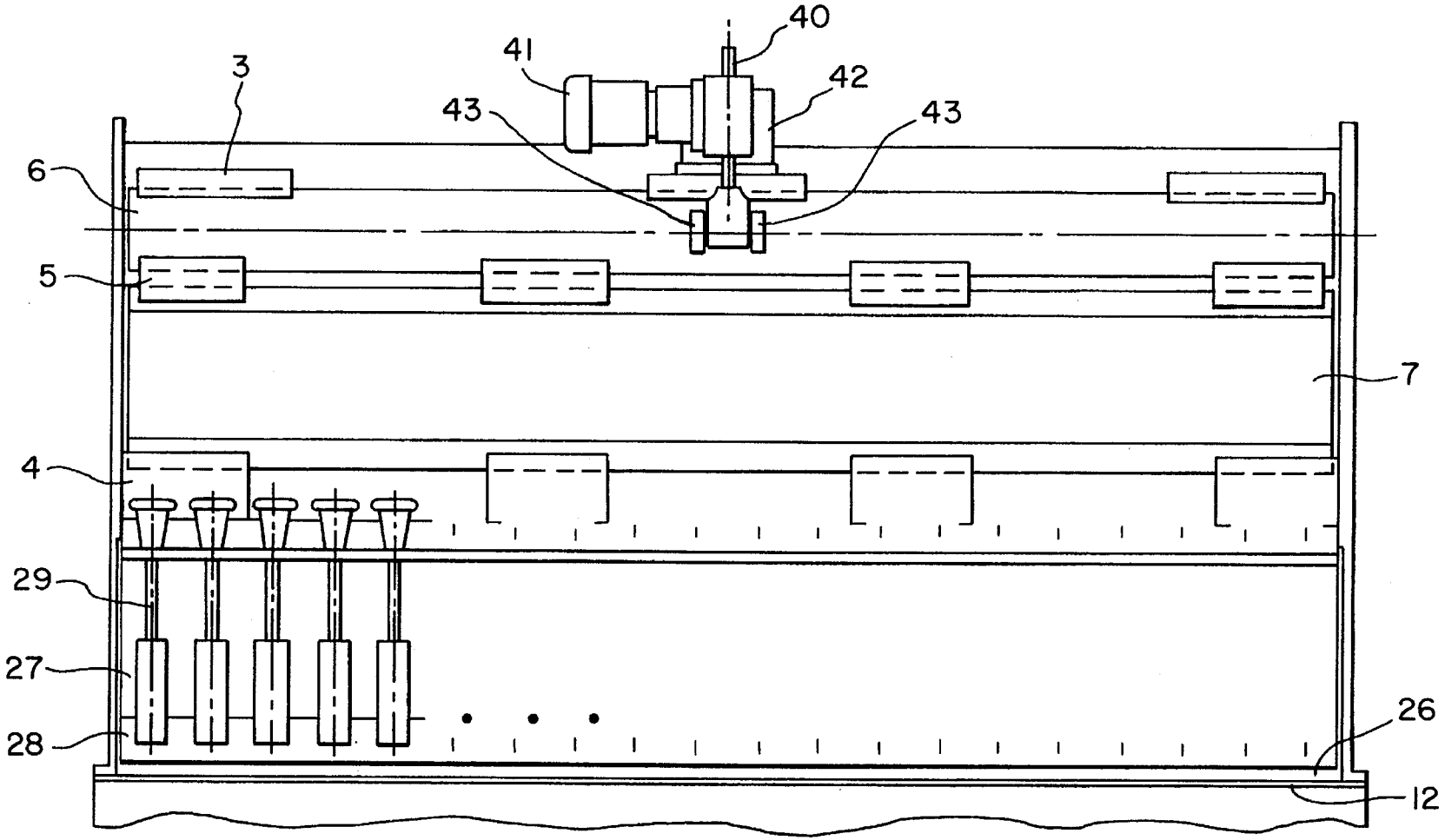
FIG. 3 is a front view of the embodiment shown in FIG. 1.

FIG. 2 discloses another embodiment of a support plate 7' of the present invention. Support plate 7' is of hollow construction and is formed from two plates which extend generally parallel to each other and are connected at respective opposite ends to cylindrical elongated members 44. Cylindrical elongated members 44 may be pivotally carried by sockets 4, 5. Support plate 7' is hollow for the purpose of circulating a fluid therethrough, such as a liquid in the form of hot water, and thereby maintaining support plate 7' in an isothermal state and preventing thermal distortions.

In the embodiments shown, solid support plate 7 and hollow support plate 7' are constructed of carbon steel or stainless steel. Preferably, support plates 7, 7' have a stainless steel lining thereover for the purpose of preventing heat transfer from an exterior medium, regardless of whether support plate 7, 7' is constructed of carbon steel or stainless steel. If hollow support plate 7' is formed of carbon steel with a stainless steel liner, then a fluid other than water (such as oil) is circulated therein to prevent oxidation.

Further, in the embodiments shown, support plate 7 is moved utilizing spindle drive assembly 39 and rotating beam 6. However, it is also possible for other structure to be utilized to move plate 7 and thereby move slice beam 27. For example, it may be possible to drive rotating beam from a longitudinal end thereof in a rotational direction. Moreover, it may be possible to connect end 7*b* to a different type of driver other than a rotating beam which moves support plate 7, thereby effecting movement of slice beam 27.

Moreover, in the embodiments shown, support plate 7 is shown and described as being connected to front wall 19. However, it should also be understood that it may be possible for support plate 7 to be connected with top wall 25. That is, housing 3 carrying rotating beam 6 can be connected to front wall 19 and/or top wall 25; the important criteria being that support plate 7 is connected to a very rigid portion of headbox 10, thereby inhibiting deflection of slice beam 27.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A headbox for a machine used in the production of a fiber material web from a fiber suspension, said headbox comprising:

a bottom and a plurality of walls defining a main chamber, said plurality of walls including a front wall;

a slice beam pivotably connected to at least one of said walls and disposed adjacent to said front wall, said slice beam having a slice blade, said slice blade and said bottom defining an adjustable discharge gap therebetween, said slice beam defining a width of said outlet channel; and a support plate separate from said walls defining said main chamber and disposed in front of said front wall and extending substantially across said width and pivotably connected at opposing first and second edges thereof to each of said front wall and said slice beam an adjustment mechanism connected to said support plate, said support plate being moveable whereby movement of said support plate via said adjustment mechanism provides adjustment of said discharge gap, and wherein said support plate inhibits deflections of said slice beam along said width.

2. The headbox of claim 1, wherein each of said first and second edges are continuously and pivotably connected to each of said front wall and said slice beam across said width.

3. The headbox of claim 1, further comprising a rotating beam interconnecting said support plate and said front wall.

4. The headbox of claim 1, wherein said support plate is hollow.

5. A headbox for a machine used in the production of a fiber material web from a fiber suspension, said headbox comprising:

a bottom and a plurality of walls defining a main chamber, said plurality of walls including a front wall;

a slice beam pivotably connected to at least one of said walls and disposed adjacent to said front wall, said slice beam and said bottom defining an adjustable outlet channel therebetween, said slice beam defining a width of said outlet channel;

a support plate extending substantially across said width and pivotably connected at opposing first and second edges thereof to each of said front wall and said slice beam, said support plate inhibiting deflections of said slice beam along said width;

a rotating beam interconnecting said support plate and said front wall; and a spindle drive assembly connected to said rotating beam, said spindle drive assembly defining a means for rotating said rotating beam and pivoting said slice beam relative to said front plate.

6. A headbox for a machine used in the production of a fiber material web from a fiber suspension, said headbox comprising:

a bottom and a plurality of walls defining a main chamber, said plurality of walls including a front wall;

a slice beam pivotably connected to at least one of said walls and disposed adjacent to said front wall, said slice beam and said bottom defining an adjustable outlet channel therebetween, said slice beam defining a width of said outlet channel; and a support plate extending substantially across said width and pivotably connected at opposing first and second edges thereof to each of said front wall and said slice beam, said support plate inhibiting deflections of said slice beam along said width and hingedly connected to each of a rotating beam and said slice beam; said rotating beam interconnecting said support plate and said front wall.

7. A headbox for a machine used in the production of a fiber material web from a fiber suspension, said headbox comprising:

a bottom and a plurality of walls defining a main chamber, said plurality of walls including a front wall;

a slice beam pivotably connected to at least one of said walls and disposed adjacent to said front wall, said slice beam and said bottom defining an adjustable outlet channel therebetween, said slice beam defining a width of said outlet channel;

a support plate extending substantially across said width and pivotably connected at opposing first and second edges thereof to each of said front wall and said slice beam, said support plate inhibiting deflections of said slice beam along said width; and a rotating beam interconnecting said support plate and said front wall; wherein said rotating beam and said slice beam each include a female socket extending across said width, and said first and second edges each comprise a male member which is pivotably and non-removably disposed in a respective said female socket.

8. A headbox for a machine used in the production of a fiber material web from a fiber suspension, said headbox comprising:

a bottom and a plurality of walls defining a main chamber, said plurality of walls including a front wall and a top wall;

a slice beam pivotably connected to at least one of said walls and disposed adjacent to said front wall, said slice beam having a slice blade, said slice blade and said bottom defining an adjustable discharge gap therebetween, said slice beam defining a width of said outlet channel;

a support plate separate from said walls defining said main chamber and disposed in front of said front wall and extending substantially across said width and pivotably connected to said slice beam;

means, pivotably connected to said support plate and rigidly connected to at least one of said front wall and said top wall, for moving said support plate and thereby adjusting said discharge gap by pivoting said slice beam relative to said front wall and inhibiting deflections of said slice beam along said width.

9. The headbox of claim 8, wherein said support plate is continuously connected to said slice beam across said width.

10. A headbox for a machine used in the production of a fiber material web from a fiber suspension, said headbox comprising:

a bottom and a plurality of walls defining a main chamber, said plurality of walls including a front wall and a top wall;

a slice beam pivotably connected to at least one of said walls and disposed adjacent to said front wall, said slice beam and said bottom defining an adjustable outlet channel therebetween, said slice beam defining a width of said outlet channel;

a support plate extending substantially across said width and pivotably connected to said slice beam;

a rotating beam interconnecting said support plate and said front wall; and a spindle drive assembly connected to said rotating beam, said spindle drive assembly defining a means for rotating said rotating beam and pivoting said slice beam relative to said front plate.

* * * * *